US009543658B2

(12) United States Patent
Lee et al.

(10) Patent No.: US 9,543,658 B2
(45) Date of Patent: Jan. 10, 2017

(54) SATELLITE ANTENNA

(71) Applicant: Wistron NeWeb Corp., Hsinchu (TW)

(72) Inventors: Ming-Chan Lee, Hsinchu (TW); Hung-Yuan Lin, Hsinchu (TW); Lan-Chun Yang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 156 days.

(21) Appl. No.: 14/601,736

(22) Filed: Jan. 21, 2015

(65) Prior Publication Data

US 2015/0214632 A1 Jul. 30, 2015

(30) Foreign Application Priority Data

Jan. 29, 2014 (TW) ..... 103103416 A

(51) Int. Cl.
*H01Q 19/13* (2006.01)
*H01Q 1/08* (2006.01)

(52) U.S. Cl.
CPC ..... *H01Q 19/13* (2013.01); *H01Q 1/084* (2013.01)

(58) Field of Classification Search
CPC ..... H01Q 19/13; H01Q 1/084; H01Q 3/04
USPC ..... 343/781 P, 781 R, 781 CA, 878, 880, 882,343/DIG. 2
See application file for complete search history.

(56) References Cited

U.S. PATENT DOCUMENTS 5,355,145 A * 10/1994 Lucas ..... H01Q 3/04 343/766
5,604,508 A * 2/1997 Atkinson ..... H01Q 1/1242 343/725
5,929,817 A * 7/1999 Clark ..... H01Q 1/1235 343/711
6,445,361 B2 * 9/2002 Liu ..... 343/878
7,411,562 B2 * 8/2008 Lin ..... H01Q 1/125 248/121
7,737,900 B1 * 6/2010 Saindon ..... H01Q 3/08 343/757
8,531,347 B2 * 9/2013 Kirby ..... H01Q 1/084 343/878

FOREIGN PATENT DOCUMENTS

TW M282332 U 12/2005
TW M370841 U1 12/2009
TW M372542 U 1/2010
TW M453255 U 5/2013
TW M468031 U 12/2013

* cited by examiner

*Primary Examiner* — Tho G Phan
(74) *Attorney, Agent, or Firm* — Muncy, Geissler, Olds & Lowe, P.C.

(57) ABSTRACT

A satellite antenna is provided, including a dish, a bracket, an extension rod and a receiver. The dish includes a reflective surface and a back surface. The bracket is connected to the back surface, wherein the bracket includes a pivot portion. The extension rod includes a first end and a second end, wherein the first end pivots on the pivot portion of the bracket, the extension rod is adapted to be rotated between a first orientation and a second orientation around a pivoting axis. The receiver is disposed on the second end of the extension rod and corresponds to the reflective surface, wherein the pivoting axis is located between the reflective surface and the receiver.

16 Claims, 15 Drawing Sheets

SATELLITE ANTENNA

CROSS REFERENCE TO RELATED APPLICATIONS

This Application claims priority of Taiwan Patent Application No. 103103416, filed on Jan. 29, 2014, the entirety of which is incorporated by reference herein.

BACKGROUND OF THE INVENTION

Field of the Invention

The present invention relates to a satellite antenna, and in particular to a satellite antenna which can be easily packaged.

Description of the Related Art

A conventional satellite antenna comprises a dish, a bracket and an extension rod. The dish is connected to the bracket. The extension rod extends from the bracket toward a front of the dish. Conventionally, the extension rod must be packaged separately to prevent it from colliding with the dish, and the user must assemble the extension rod with the dish, and the assembly process is inconvenient for the user. Additionally, during assembly, the user may damage the satellite antenna (especially the reflective surface of the dish), thereby compromising the transmission efficiency of the satellite antenna.

BRIEF SUMMARY OF THE INVENTION

A satellite antenna is provided, including a dish, a bracket, an extension rod and a receiver. The dish includes a reflective surface and a back surface. The bracket is connected to the back surface, wherein the bracket comprises a pivot portion. The extension rod includes a first end and a second end, wherein the first end pivots on the pivot portion of the bracket, the extension rod is adapted to be rotated between a first orientation and a second orientation around a pivoting axis. The receiver is disposed on the second end of the extension rod and corresponds to the reflective surface, wherein the pivoting axis is located between the reflective surface and the receiver.

Utilizing the satellite antenna of the embodiment of the invention, the extension rod can be rotated relative to the bracket to be received in the depression structure of the reflective surface, and the satellite antenna therefore can be easily packaged, and the extension rod can be pre-assembled rather than assembled by the user. In the satellite antenna of the embodiment of the invention, the extension rod would not interfere with the reflective surface when being received. The dimension of the opening on the reflective surface can be reduced to maintain the signal transmission effect.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
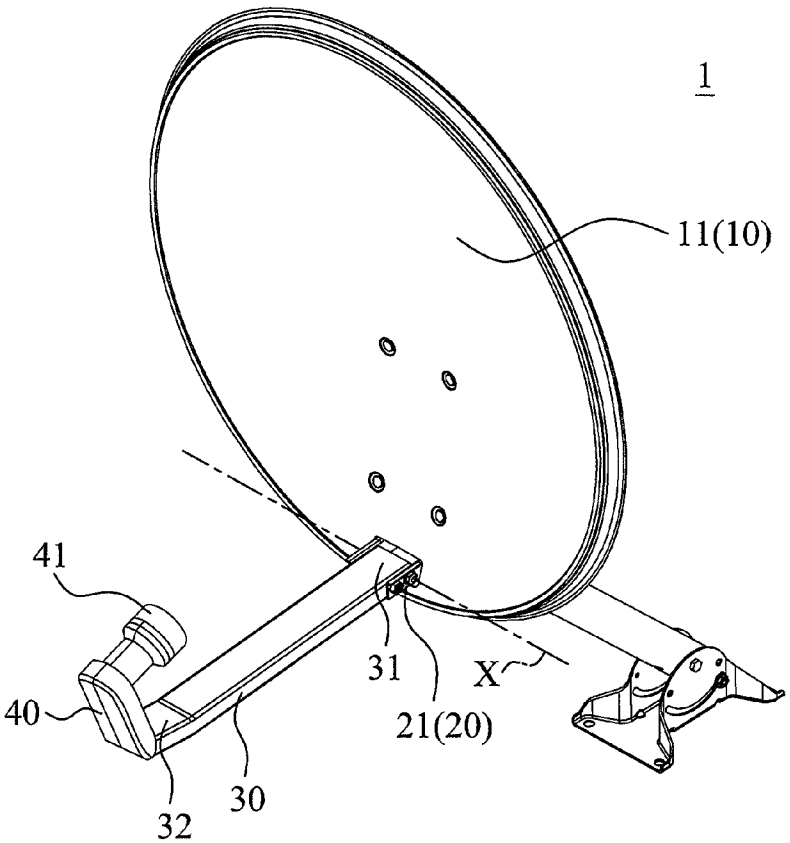
FIG. 1 shows a satellite antenna of an embodiment of the invention.
Figure 2A:
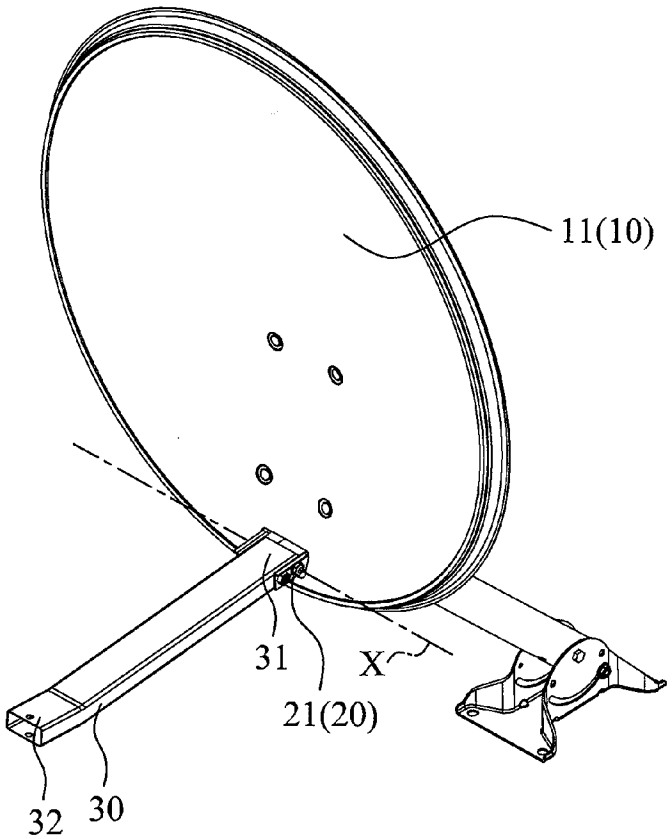
FIG. 2A shows the satellite antenna of the embodiment of the invention, wherein the extension rod is in the first orientation.
Figure 2B:
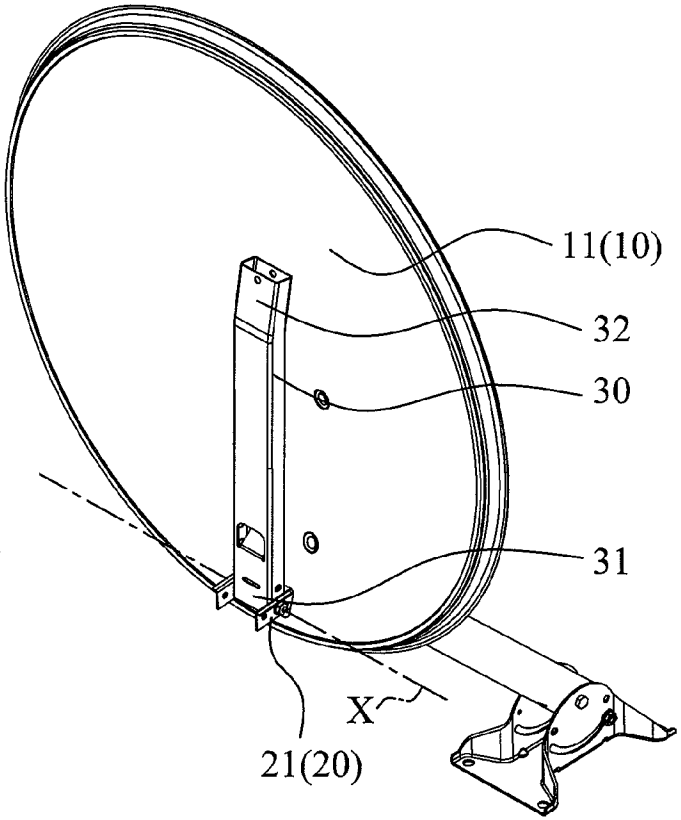
FIG. 2B shows the satellite antenna of the embodiment of the invention, wherein the extension rod is in the second orientation.
Figure 3:
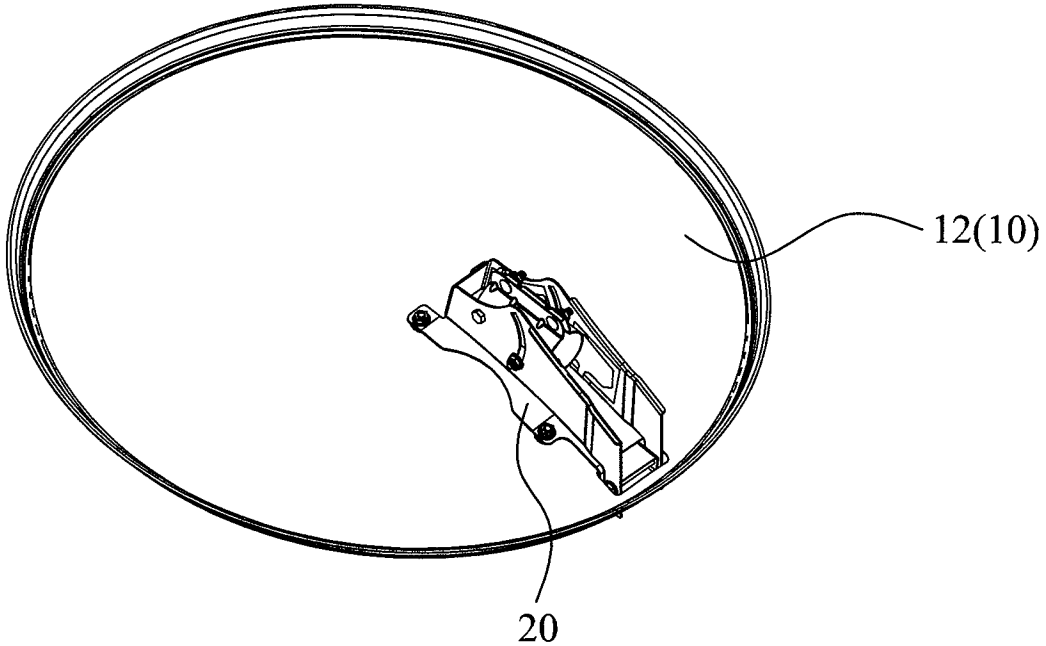
FIG. 3 shows a back structure of the satellite antenna of the embodiment of the invention.

FIGS. 1, 2A, 2B and 3 show a satellite antenna 1 of an embodiment of the invention, comprising a dish 10, a bracket 20, an extension rod 30 and a receiver 40. The dish 10 comprises a reflective surface 11 and a back surface 12 (FIG. 3). The bracket 20 is connected to the back surface 12, wherein the bracket 20 comprises a pivot portion 21. The extension rod 30 comprises a first end 31 and a second end 32, wherein the first end 31 pivots on the pivot portion 21 of the bracket 20. With reference to FIGS. 2A and 2B, when the receiver 40 is detached, the extension rod 30 is adapted to be rotated between a first orientation (FIG. 2A) and a second orientation (FIG. 2B) around a pivoting axis X. With reference to FIG. 1, the receiver 40 is disposed on the second end 32 of the extension rod 30 and corresponds to the reflective surface 11, wherein the pivoting axis X is located between the reflective surface 11 and the receiver 40. In one embodiment, the receiver 40 comprises a wave guide 41, and the wave guide 41 faces the reflective surface 11.

Figure 4:
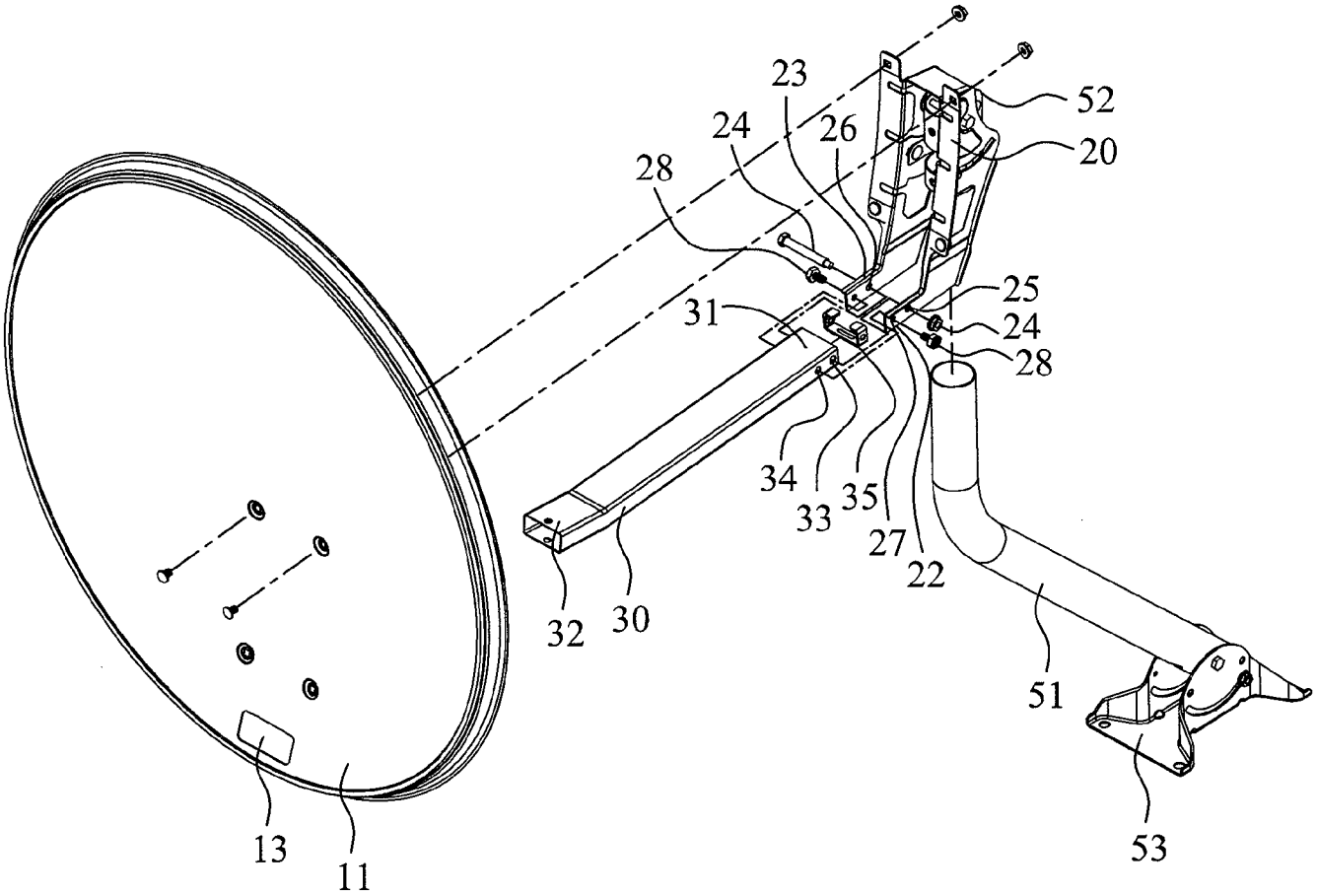
FIG. 4 is an exploded view of the satellite antenna of the embodiment of the invention.

FIG. 4 is an exploded view of the satellite antenna of the embodiment of the invention. With reference to FIGS. 1-4, an opening 13 is formed on the dish 10, and the pivot portion 21 of the bracket 20 extends from the back surface 12, passing through the opening 13 and protruding from the reflective surface 11. The opening 13 is rectangular, and a major axis of the opening 13 is parallel to the pivoting axis X. In one embodiment, the ratio between the area of the opening 13 and the area of a cross section of the extension rod 30 (in this application, the area of the cross section of the extension rod 30 includes the area of a tube body of the extension rod and the area of the hollow portion thereof) is smaller than 2.3. In one embodiment, the dimensions of the opening 13 are 66 mm*35 mm.

With reference to FIG. 4, in this embodiment, the pivot portion 21 comprises a first wall 22, a second wall 23 and a pivot element 24. The first wall 22 faces the second wall 23.

A first pivot hole 25 is formed on the first wall 22, and a second pivot hole 26 is formed on the second wall 23. The extension rod 30 comprises pivot openings 33, and the pivot element 24 passes through the first pivot hole 25, the pivot openings 33 of the extension rod 30 and the second pivot hole 26. The pivot element 24 is located on the pivot axis X, and the extension rod 30 is rotated around the pivot element 24.

With reference to FIG. 4, in this embodiment, the fixing holes 27 are formed on the first wall 22 and the second wall 23. Fastening holes 34 are formed on both sides of the extension rod 30. The pivot portion 21 further comprises a fixing element 28. When the extension rod 30 is in the first orientation, the fixing holes 27 correspond to the fastening holes 34, and the fixing element 28 passes through the fixing holes 27 and the fastening holes 34 to fix the orientation of the extension rod 30.

The extension rod 30 is a tube, and signal lines extend in the extension rod 30. The extension rod 30 further comprises a fixing unit 35, the fixing unit 35 is disposed in the extension rod 30, and the fixing element 28 passes through the fixing hole 27 and the fastening holes 34 to be fixed with the fixing unit 35. In this embodiment, the cross section of the fixing unit 35 is U-shaped.

Figure 5:
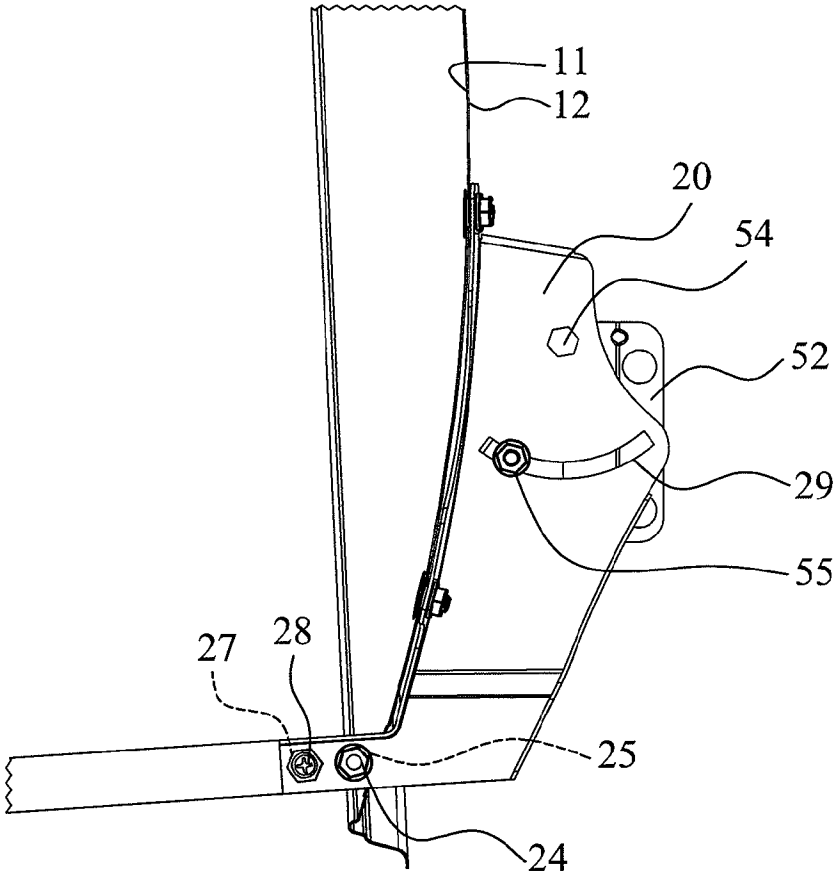
FIG. 5 is a side view of a portion of the satellite antenna of the embodiment of the invention.

With reference to FIGS. 4 and 5, in this embodiment, the pivot openings 33 are located between the fastening holes 34 and the reflective surface 11. The reflective surface 11 forms a depression structure. With reference to FIG. 2B, when the extension rod 30 is in the second orientation, at least a portion of the extension rod 30 is located in the depression structure. In this embodiment, an included angle between the first orientation and the second orientation is smaller than 100 degrees; for example, it is 96 degrees.

With reference to FIGS. 4 and 5, in one embodiment, the bracket 20 is fixed to the back surface 12 by screw. The satellite antenna 1 further comprises a supporting rod 51, a supporting rod connector 52 and a fixing base 53. The supporting rod connector 52 is connected to the bracket 20. One end of the supporting rod 51 is connected to the supporting rod connector 52, and the other end of the supporting rod 51 is connected to the fixing base 53. The supporting rod 51 pivots on the fixing base 53. The bracket 20 pivots on the supporting rod connector 52 on a connector pivot portion 54. In one embodiment, the supporting rod 51 is a circular tube.

With reference to FIGS. 4 and 5, the bracket 20 comprises sliding grooves 29. The supporting rod connector 52 comprises a fastening element 55. The fastening element 55 passes through the sliding grooves 29 to be fixed to the supporting rod connector 52 to fix the supporting rod connector 52 in an orientation relative to the bracket 20.

Utilizing the satellite antenna of the embodiment of the invention, the extension rod can be rotated relative to the bracket to be received in the depression structure of the reflective surface, and the satellite antenna can therefore be easily packaged, and the extension rod can be pre-assembled rather than assembled by the user. In the satellite antenna of the embodiment of the invention, the extension rod would not interfere with the reflective surface when being received. The dimensions of the opening on the reflective surface can be decreased to maintain signal transmission effect. Additionally, experiment shows that, though the pivot portion extends from the back surface, passing through the opening, and protruding from the reflective surface, the pivot portion only slightly affects the signal transmission. The embodiment of the invention improves convenience without deteriorating signal transmission.

Figure 6:
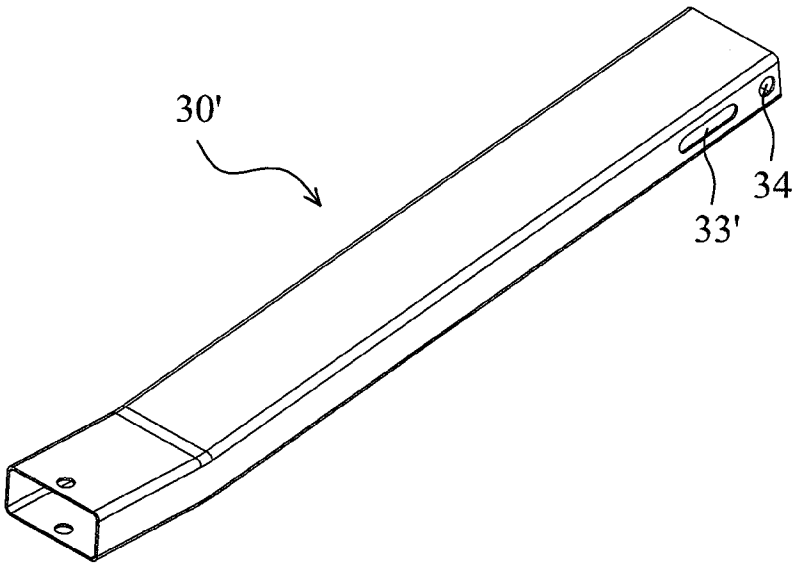
FIG. 6 shows an extension rod of a modified example of the invention.
Figure 7A:
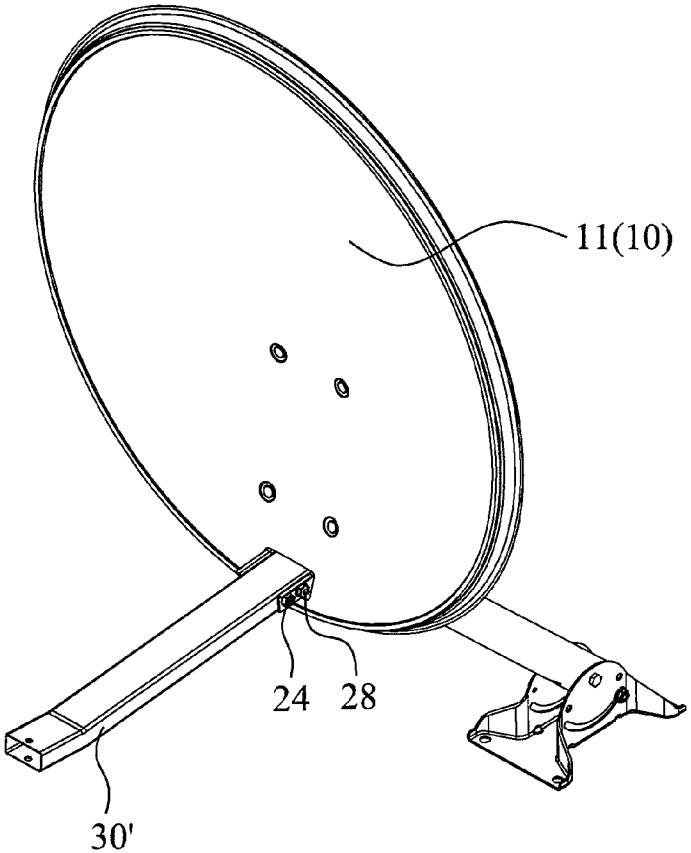
FIGS. 7A, 7B, 7C and 7D show a packaging process of the satellite antenna of the modified example of the invention.
Figure 7B:
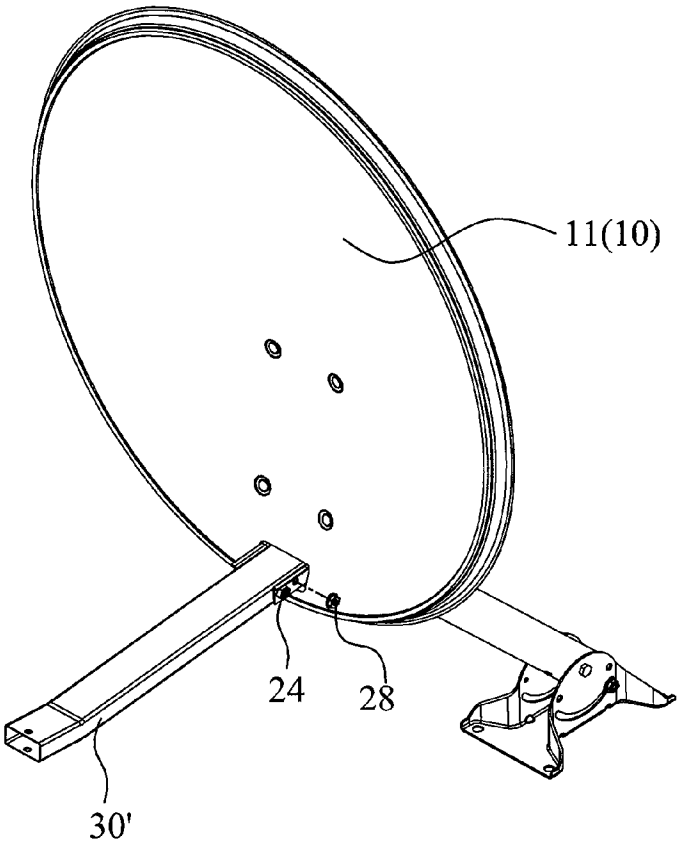
Figure 7C:
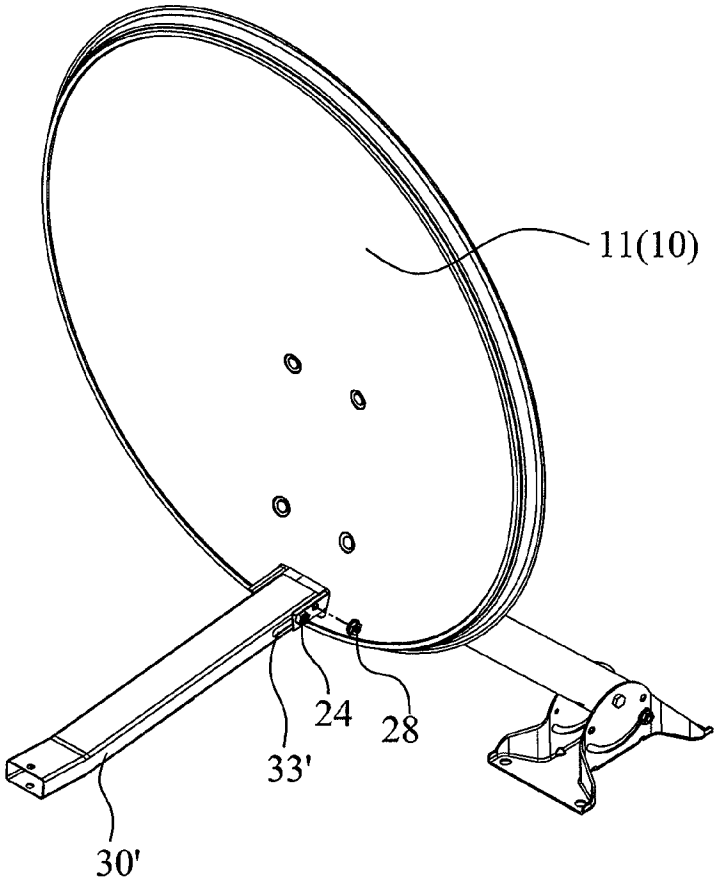
Figure 7D:
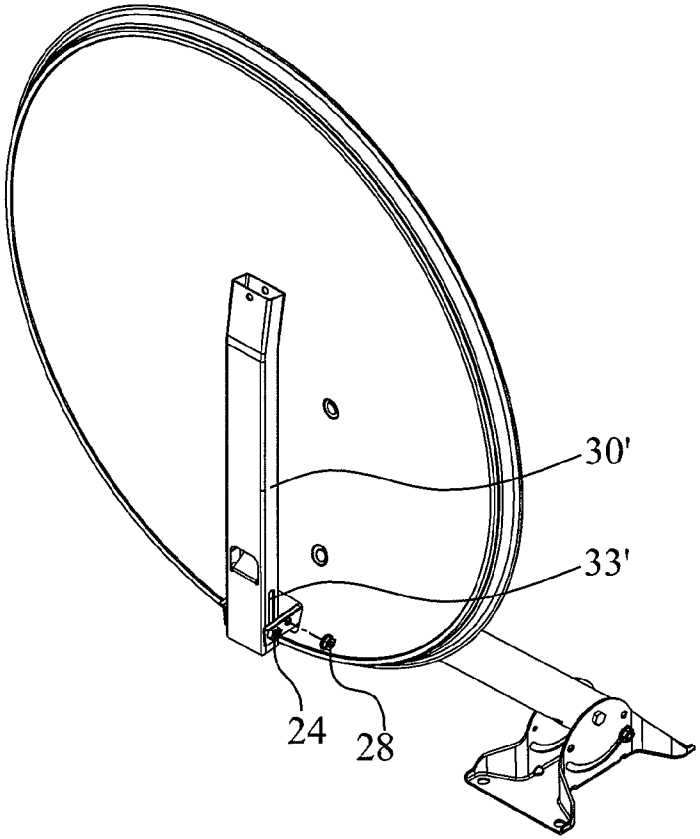

FIG. 6 shows a modified example of the invention, which is characteristic in that the pivot openings 33' on the extension rod 30' are modified as a slot. In this embodiment, the fastening holes 34 are located between the pivot openings 33' and the reflective surface 11. With reference to FIGS. 7A, 7B, 7C and 7D, when the extension rod 30' is being received, the fixing element 28 is detached (FIGS. 7A and 7B). Then, the extension rod 30' is pushed forward (FIG. 7C). Finally, the extension rod 30' is rotated to be received. Utilizing the embodiment of FIG. 6, though the fastening holes 34 are located between the pivot openings 33' and the reflective surface 11, the end of the extension rod 30' still would not be interference with the reflective surface when being rotated.

Figure 8A:
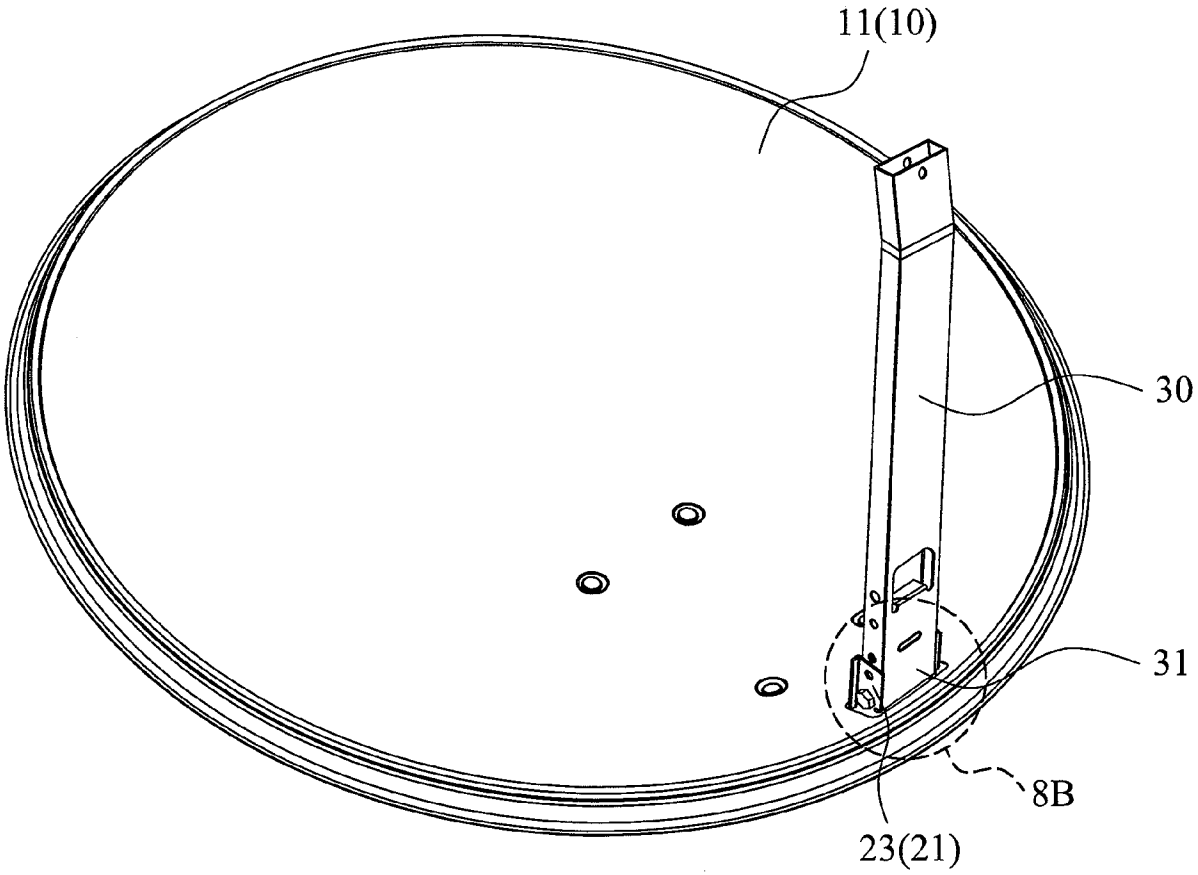
FIG. 8A shows a satellite antenna of another modified example of the invention, wherein the extension rod is in the first orientation.
Figure 8B:
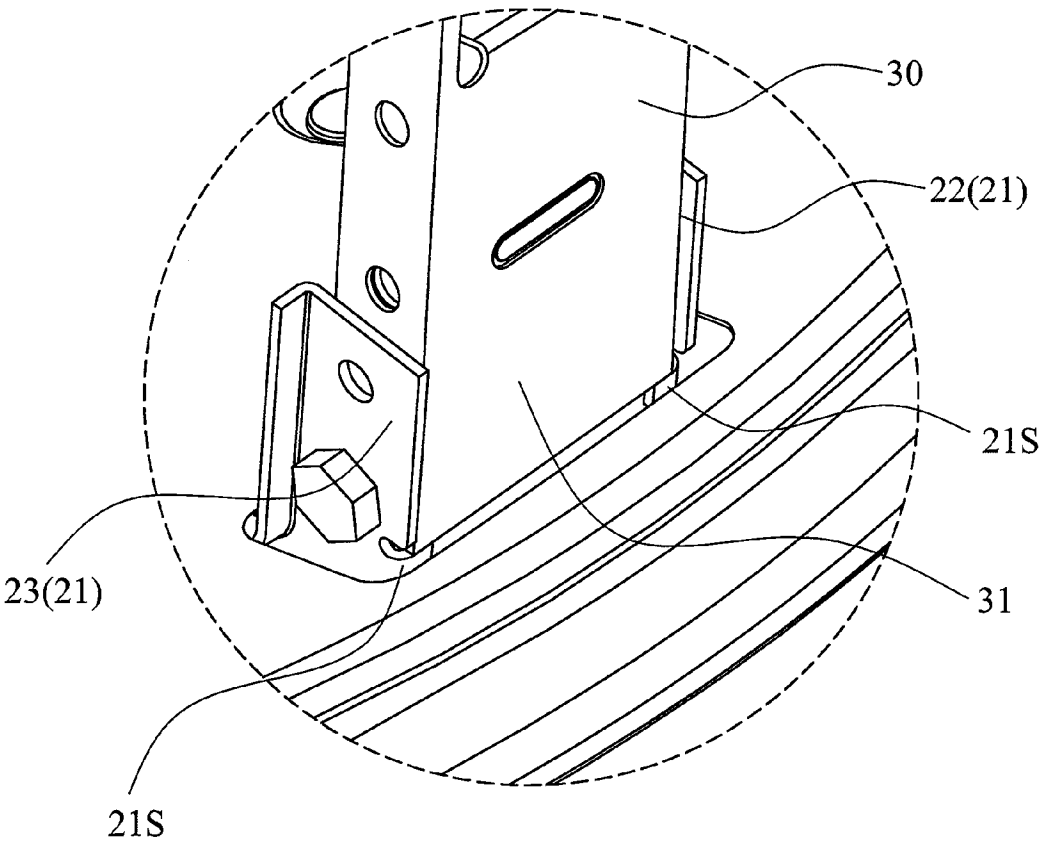
FIG. 8B is an enlarged view of portion 8B of FIG. 8A.
Figure 8C:
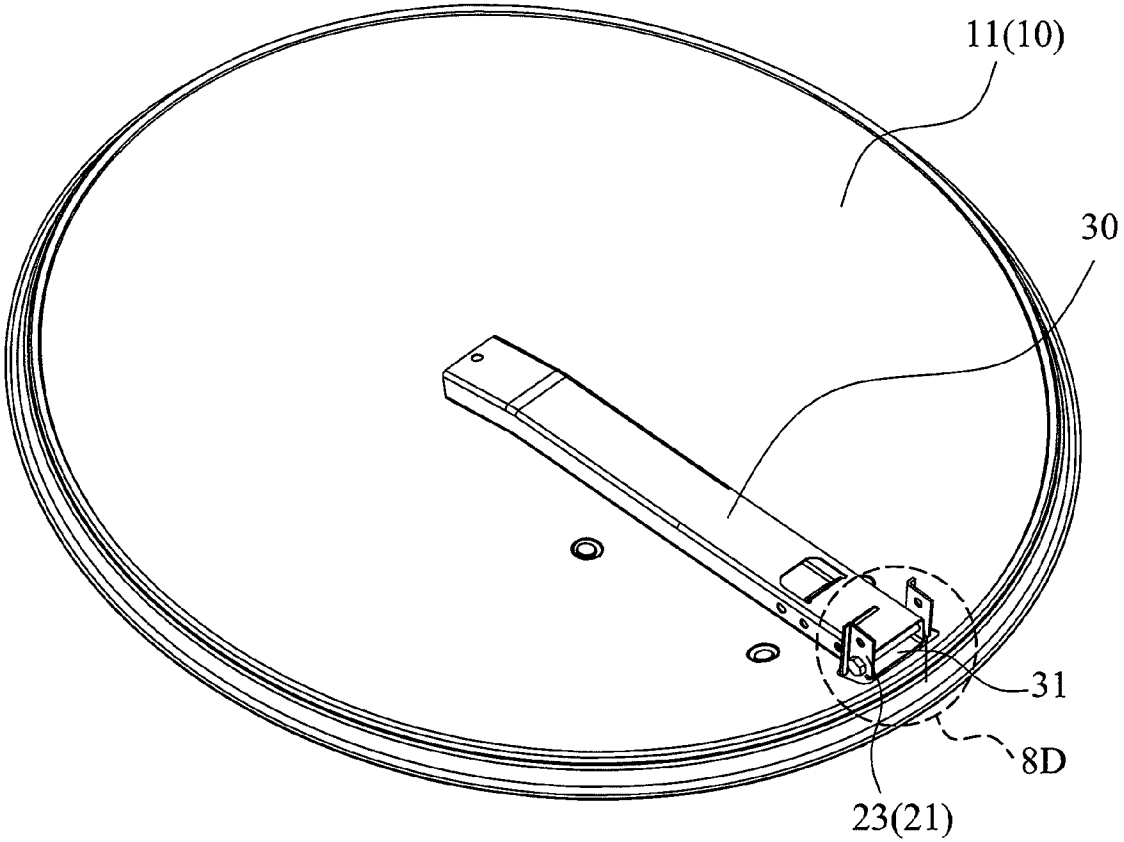
FIG. 8C shows the satellite antenna of the example of FIG. 8A, wherein the extension rod is in the second orientation.
Figure 8D:
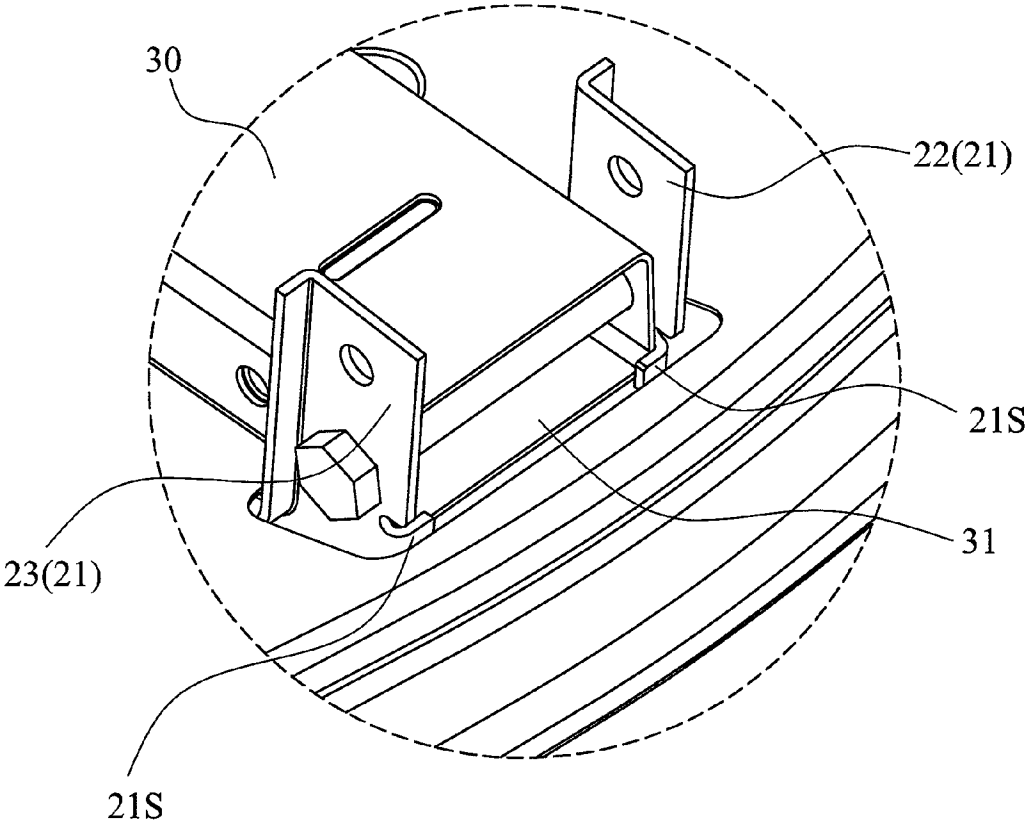
FIG. 8D is an enlarged view of portion 8D of FIG. 8C.

FIGS. 8A-8D shows another modified example of the invention, which is characteristic in that the pivot portion 21 further comprises a stopper 21S. When the extension rod 30 is in the first orientation, the stopper 21S abuts the first end 31 of the extension rod 30 to restrict the position of the extension rod 30 in the first orientation to ensure signal adequate transmission effect (FIGS. 8A and 8B). When the extension rod 30 is in the second orientation, the stopper 21S abuts the first end 31 to prevent the extension rod 30 from colliding with the reflective surface 11 of the dish 10 (FIGS. 8C and 8D). In this embodiment, an included angle between the first orientation and the second orientation is smaller than 100 degrees, for example, 96 degrees.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A satellite antenna, comprising:

a dish, comprising a reflective surface and a back surface;

a bracket, connected to the back surface, wherein the bracket comprises a pivot portion;

an extension rod, comprising a first end and a second end, wherein the first end pivots on the pivot portion of the bracket, and the extension rod is adapted to be rotated between a first orientation and a second orientation around a pivoting axis; and a receiver, disposed on the second end of the extension rod and corresponding to the reflective surface, wherein the pivoting axis is located between the reflective surface and the receiver, wherein an opening is formed on the dish, and the pivot portion of the bracket extends from the back surface, passes through the opening, and protrudes from the reflective surface.

2. The satellite antenna as claimed in claim 1, wherein the opening is rectangular, and a major axis of the opening is parallel to the pivoting axis.

3. The satellite antenna as claimed in claim 2, wherein a ratio between an area of the opening and an area of a cross section of the extension rod is smaller than 2.3.

4. The satellite antenna as claimed in claim 1, wherein the pivot portion comprises a first wall, a second wall and a pivot element, the first wall faces the second wall, a first pivot hole is formed on the first wall, a second pivot hole is formed on the second wall, the extension rod comprises at least one pivot opening, the pivot element passes through the first pivot hole, the pivot opening of the extension rod and the second pivot hole, the pivot element is located on the pivot axis, and the extension rod is rotated around the pivot element.

5. The satellite antenna as claimed in claim 4, wherein a fixing hole is formed on the first wall, a fastening hole is formed on the extension rod, the pivot portion further comprises a fixing element, and when the extension rod is in the first orientation, the fixing hole corresponds to the fastening hole, and the fixing element passes through the fixing hole and the fastening hole to fix the extension rod.

6. The satellite antenna as claimed in claim 5, wherein the extension rod is a tube, the extension rod further comprises a fixing unit, the fixing unit is disposed in the extension rod, and the fixing element passes through the fixing hole and the fastening hole to be fixed to the fixing unit.

7. The satellite antenna as claimed in claim 5, wherein a cross section of the fixing unit is U-shaped.

8. The satellite antenna as claimed in claim 5, wherein the pivot opening is circular, and the pivot opening is located between the fastening hole and the reflective surface.

9. The satellite antenna as claimed in claim 5, wherein the pivot opening is a slot, and the fastening hole is located between the pivot opening and the reflective surface.

10. The satellite antenna as claimed in claim 1, wherein an included angle between the first orientation and the second orientation is smaller than 100 degrees.

11. The satellite antenna as claimed in claim 1, wherein the reflective surface forms a depression structure, and when the extension rod is in the second orientation, at least a portion of the extension rod is located in the depression structure.

12. The satellite antenna as claimed in claim 1, wherein the pivot portion further comprises a stopper, and when the extension rod is in the first orientation, the stopper abuts a bottom side of the first end of the extension rod, and the stopper restricts a position of the extension rod, and when the extension rod is in the second orientation, the stopper abuts an end side of the first end to prevent the extension rod from colliding with the reflective surface of the dish.

13. The satellite antenna as claimed in claim 1, wherein the receiver comprises a wave guide, and the wave guide faces the reflective surface.

14. The satellite antenna as claimed in claim 1, further comprising a supporting rod, a supporting rod connector and a fixing base, wherein the supporting rod connector is connected to the bracket, an end of the supporting rod is connected to the supporting rod connector, and the other end of the supporting rod is connected to the fixing base.

15. The satellite antenna as claimed in claim 14, wherein the bracket pivots on the supporting rod connector.

16. The satellite antenna as claimed in claim 15, wherein the bracket comprises a sliding groove, the supporting rod connector comprises a fastening element, and the fastening element passes through the sliding groove to be fixed to the supporting rod connector to fix an orientation of the supporting rod connector relative to the bracket.

* * * * *